United States Patent [19]

Ibrahim

[11] Patent Number: 4,858,452

[45] Date of Patent: Aug. 22, 1989

[54] NON-COMMUTATED LINEAR MOTOR

[75] Inventor: Faik K. Ibrahim, Columbus, Miss.

[73] Assignee: United Technologies Electro Systems, Inc., Columbus, Miss.

[21] Appl. No.: 945,441

[22] Filed: Dec. 22, 1986

[51] Int. Cl.[4] ..... E05B 51/00

[52] U.S. Cl. ..... 70/275; 70/276; 70/264; 70/271; 310/12; 310/13; 310/14

[58] Field of Search ..... 70/275, 276, 262–264, 70/266–271; 310/12–14

[56] References Cited

U.S. PATENT DOCUMENTS

| | | | |
|---|---|---|---|
| 2,505,401 | 4/1950 | Ingres et al. | 70/262 X |
| 2,672,943 | 3/1954 | Chatlynne et al. | 70/262 X |
| 2,674,334 | 4/1954 | Uberbacher | 70/262 X |
| 2,716,568 | 8/1955 | Davies | 70/262 X |
| 2,989,666 | 6/1961 | Brenner et al. | 310/12 X |
| 3,001,115 | 9/1961 | Gendreu et al. | 310/12 X |
| 3,064,752 | 11/1962 | Deibel et al. | 70/262 X |
| 3,148,292 | 9/1984 | Bergslien et al. | 310/13 |
| 3,430,120 | 2/1969 | Kotaka et al. | 310/14 X |
| 3,486,352 | 12/1969 | Bouthors et al. | 70/264 |
| 3,550,408 | 12/1970 | Archaux et al. | 70/264 |
| 3,593,816 | 7/1971 | Kazaoka | 70/264 X |
| 3,612,207 | 10/1971 | Cabanes et al. | 70/264 X |
| 3,720,084 | 3/1973 | Ventre et al. | 70/264 |
| 3,747,379 | 7/1973 | Cabanes | 70/264 |
| 3,798,936 | 3/1974 | Oliver | 70/264 |
| 3,805,099 | 4/1974 | Kelly | 310/12 |
| 3,883,633 | 5/1975 | Kohler | 310/72 X |
| 3,896,319 | 7/1975 | Chari | 310/14 |
| 3,971,241 | 7/1976 | Parsson | 70/275 |
| 4,188,552 | 2/1980 | Brimer | 310/13 |
| 4,215,283 | 7/1980 | Hinds | 310/14 |
| 4,217,507 | 8/1980 | Jaffe et al. | 310/12 |
| 4,227,100 | 10/1980 | Ezekiel et al. | 310/13 |
| 4,234,831 | 11/1980 | Kemmer et al. | 310/12 X |
| 4,314,295 | 2/1982 | Frandsen | 360/104 |
| 4,369,383 | 1/1983 | Langley | 310/12 |
| 4,394,592 | 7/1983 | Pataki | 310/12 |
| 4,439,698 | 3/1984 | Chen | 310/12 |
| 4,439,699 | 3/1984 | Brende et al. | 310/13 |
| 4,466,263 | 8/1984 | Rathmann | 70/275 X |
| 4,480,202 | 10/1984 | Leutner et al. | 310/12 |
| 4,498,023 | 2/1985 | Stout | 310/14 |
| 4,518,881 | 5/1985 | Stupak, Jr. | 310/13 |
| 4,533,890 | 8/1985 | Patel | 310/14 X |
| 4,542,311 | 9/1985 | Newman et al. | 310/13 |
| 4,543,789 | 10/1985 | Norton | 60/545 |
| 4,585,397 | 4/1986 | Crawford et al. | 417/63 |
| 4,602,232 | 7/1986 | Umehara et al. | 335/222 |
| 4,608,908 | 9/1986 | Carlson et al. | 310/12 X |
| 4,625,132 | 11/1986 | Chitayat | 310/13 |
| 4,631,430 | 12/1986 | Aubrecht | 310/14 X |
| 4,669,283 | 6/1987 | Ingenhoven | 70/264 |

FOREIGN PATENT DOCUMENTS

| | | | |
|---|---|---|---|
| 0059658 | 9/1982 | European Pat. Off. | 70/275 |
| 3017731 | 11/1981 | Fed. Rep. of Germany | 70/275 |
| 1582518 | 1/1981 | United Kingdom | 70/275 |

*Primary Examiner*—Robert L. Wolfe
*Assistant Examiner*—Suzanne L. Dino

[57] ABSTRACT

A non-commutated linear motor particularly suitable for use as an electric door lock actuator for an automobile is disclosed. The linear motor may include a series of cup-shaped portions each having a winding appropriately connected to provide the desired travel stroke, in a direction determined by polarity of D.C. power applied to the winding, and power for the linear motor or a segmented armature designed to achieve the same flexibility in motor design and assembly.

24 Claims, 4 Drawing Sheets

NON-COMMUTATED LINEAR MOTOR

BACKGROUND OF THE INVENTION

The present invention is directed to a non-commutated electric linear motor and to an automobile door lock mechanism driven by a non-commutated linear motor. More particularly, the present invention is directed to a linear motor assembled from a series of spaced coils formed either on an armature or maintained in a series of stacked cups serving as the windings of a linear motor. The linear motor is of sufficient size to have the appropriate force and length of stroke to actuate an automobile door lock mechanism.

In many currently utilized electric door lock mechanisms, an electric motor having an electric motor armature, gears and a mechanical drive train is connected to a door lock mechanism. A typical system may include a latching bolt to secure the door to the frame of the automobile, an electric switch located inside the door for locking or unlocking the bolt, a manually-displaceable handle inside of the door for unlatching the door, a manually movable button, slide or similar device for locking and unlocking a latching bolt in the door, and, on the exterior of the door, a handle for latching and unlatching the door and a key opening for receipt of a key for unlocking and locking the latching bolts. The key receiving mechanism may be designed to either manually unlock the latching bolts or to energize a motor to unlock the latching bolts. At this point in time most entry locks utilize the motion imparted by turning the key to unlock the latching bolts.

One of the problems identified with this type of system is that the manual effort required to turn the key to unlock the latching bolt may be significant. If the ambient temperature is low, or if there is insufficient lubrication, or a key is particularly weak, in any of the above events, the force required to manually unlock the latching bolt may be such that the key is either twisted or broken in the process and entry of the car is denied.

It has been determined that one of the mechanisms acting to create the difficulty in manually unlocking the latching bolts is that the electric motor, gears, and remainder of the electric drive train to the door lock actuator are mechanically coupled thereto, and in order to manually displace the latching bolt, it is necessary to "back drive" the gear train and the electric motor as the latching bolt is displaced. Hence, additional force on the key is required and additional work is necessary to accomplish the rotation of the motor armature and the displacement of the gear train or the actuator.

The herein-described non-commutated linear motor avoids the necessity of "back driving" a gear train and a rotating motor since it is a non-commutated linear motor and displacement of the latching bolt may simply result in displacement of the linear sliding armature having but a minimal force required to effect such displacement.

Solenoids have been used in some specific car designs to power automobile door locks. However, solenoids are inherently inefficient, for the same force output are sized larger than linear motors, and typically solenoids generate a greater amount of force at the end of the travel stroke than at the beginning. Solenoids are also noisy, costly and create large induced currents in the automobile wiring system when turned on and off. These induced currents may create electrical noise problems with onboard computers and other smart devices. Because of these disadvantages the use of solenoids has all but disappeared from automotive applications.

A linear motor, on the other hand, when appropriately designed may be of compact size and be designed to accommodate the necessary travel stroke. Additionally, the linear motor may simply be designed to provide approximately constant force over its entire stroke length, thereby generating a larger amount of initial force such that the size of the entire motor may be minimized.

Additionally, by proper design of the linear motor, a compact package may be provided which is sized to fit appropriately within an automobile door. By using a motor length which may simply be adjusted by adding or deleting windings, the appropriate stroke length and other operating characteristics may be readily obtained or changed. Furthermore, a motor generating sufficient force while meeting the physical constraints of the automotive application, may also be designed which has a maximum current draw less than the maximum allowed current draw on the wire specified within the door by an automotive manufacturer.

SUMMARY OF THE INVENTION

It is an object of the present invention to provide a non-commutated linear motor.

It is a still further object of the present invention to provide a linear motor made from stacked segments to provide for flexible motor design.

It is a yet further object of the present invention to provide an improved motor and automotive door lock mechanism.

It is a yet further object of the present invention to provide a non-commutated linear motor which is easy to manufacture and assemble and which is cost effective.

It is another object of the present invention to provide a safe, economical, reliable, easy to manufacture and utilize linear motor.

Other objects will be apparent from the description to follow and the appended claims.

The above objects are achieved according to a preferred embodiment by the provision of a DC linear motor having a series of windings; a stack formed from a series of winding portions positioned to secure the windings of the motor, each portion defining a winding receiving segment in which a winding may be positioned, and a central opening; an armature including at least one permanent magnet mounted within the central opening defined by the portions; and, end means mounted to each end of the stack of winding portions, said end means including means for securing the armature for sliding motion relative to the stack of winding portions.

Also disclosed is an automobile power door lock mechanism having a latch and lock mechanism for latchably securing the door in a closed position and for locking the latch when in the closed position, said latch and lock mechanism receiving a series of mechanical inputs; a power drive mechanism connected to provide an input to the latch and lock mechanism to either lock or unlock said mechanism, said power drive mechanism including a linear motor having an armature including a shaft which is connected to the latch and lock mechanism, said shaft being driven by the linear motor between the locked and unlocked positions of the mechanism; and, said linear motor further including a series of windings, a stack formed from a series of winding portions positioned to secure the windings of the linear motor, each portion defining a winding receiving segment in which one of said windings may be positioned, a central opening through which the armature may reciprocate and means mounted to each end of the stack of winding portions for securing the armature for sliding motion relative to the stack, whereby energization of the linear motor effects displacement of the armature which is connected to the latch and lock mechanism to either lock or unlock said mechanism.

Additionally disclosed is a non-commutated linear DC motor having a circumferentially extending housing; a permanent magnet mounted to the interior of the housing and having an outer face adjacent the housing of one polarity and an inner face opposite therefrom of the opposite polarity; an armature defining a series of portions and sized to fit interior of the housing and the magnet, each portion defining a winding receiving opening, and said armature including an axially extending armature shaft; a plurality of electrically connected windings, each winding being positioned within a winding receiving opening; end bells mounted at either end of the housing to encase the armature therewithin, each end bell defining an opening through which an armature shaft may extend and be slidably supported; and, means coacting with the armature shaft to electrically connect the windings with an appropriate power source whereby upon the application of power to the windings a field is created which interacts with the field generated by the permanent magnet to cause the armature to be displaced in one of two axial directions depending on the polarity of the power supplied to the windings.

DESCRIPTION OF THE PREFERRED EMBODIMENT

The invention herein will be described with reference to several specific structures for a non-commutated linear motor. It is, of course, to be understood that other means for accomplishing the same result may be utilized. It additionally is to be understood that this particular linear motor, although described in reference to an automotive door lock actuator may have other end uses. It is further to be understood that rectangular as used herein includes square shapes.

Figure 1:
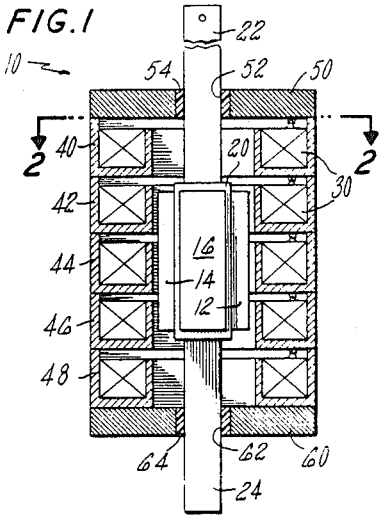
FIG. 1 is a sectional view of a non-commutated linear motor.

Referring to FIG. 1, there may be seen linear motor 10 having armature 20 mounted for reciprocating movement within a series of winding receiving segments or cups 40, 42, 44, 46 and 48. Armature 20 includes an enlarged diameter portion which is rectangular in cross section and shafts 22 and 24 extending therefrom. Mounted to the large diameter portion 23 are shown permanent magnets 12 and 14, each having a south pole facing the large diameter portion and a north pole facing outwardly therefrom.

Cups 40–48 each contain windings 30 which are a multiplicity of wires wound circumferentially within the cup and which may be energized to create an appropriate field for interaction with the permanent magnets of the armature. A cup with the winding therein may be referred to as a winding module. A series of winding modules placed adjacent to each other to form the field winding of the motor or a portion thereof may be collectively referred to as a stack of cups or winding modules. End bells 50 and 60 are located at either end of the motor, each defining a respective opening 52 and 62 in which bearings 54 and 64 are appropriately secured. The bearing may be of nylon, bronze, or other similar material and is arranged such that shafts 22 and 24 are located therewithin such that the armature may readily reciprocate between opposite ends of the linear motor.

The coils or windings are wound so that, with current flowing through them, a north magnet pole is established at one end of the armature and a south magnet pole is established at the other end, with a resulting flux field extending axially along the length of the armature. The magnets mounted to the armature are face polarized so that the outer face is of the same polarity on each exterior surface. The resulting flux field from the magnets is such that it extends into the various cups, across the air gap and to the end bells. The field generated by the magnet is effectively 90° from that generated by the energized windings. Thus, it can be seen that when the windings are energized, the resulting force of the field of the magnets will cause the armature to move axially. The direction the armature moves depends upon the direction of the current flowing through the windings. Thus the direction of travel of the armature is controlled by switching the polarity of the current supplied to the windings.

Figure 2:
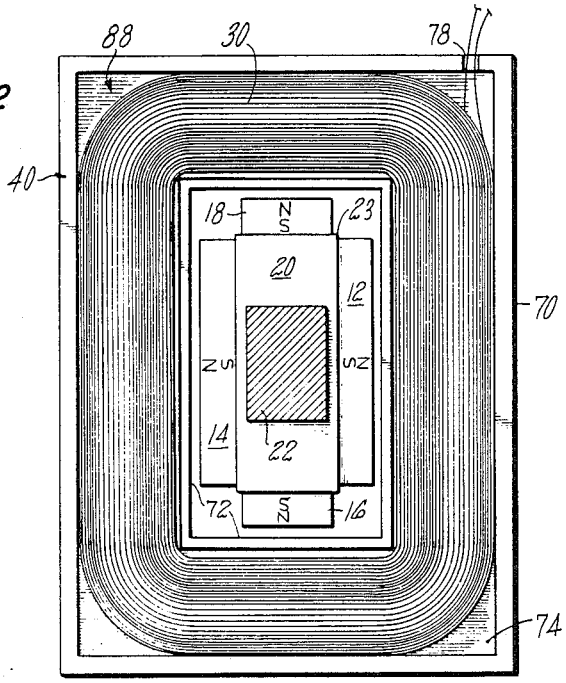
FIG. 2 is a sectional view of FIG. 1 taken at line II—II.

FIG. 2 shows windings 30 positioned within winding receiving portion 88 of cup 40. Additionally, in FIG. 2 it may be seen that armature 20 has a large cross-sectional portion 23 to which a plurality of four magnets 12, 14, 16 and 18 are mounted. It may be seen that the magnets all have a common polarity on their exterior surfaces and their interior surfaces such that an appropriate flux field is developed. Shaft 22 is shown extending upwardly from the armature.

Cup 40 is shown defining slot 78 through which a pair of wires constituting the end of windings 30 may extend such that they may be appropriately connected to a power source. Additionally, it may be seen that there is an air gap provided between the magnets and the inner wall 72 of cup 40.

Figure 3:
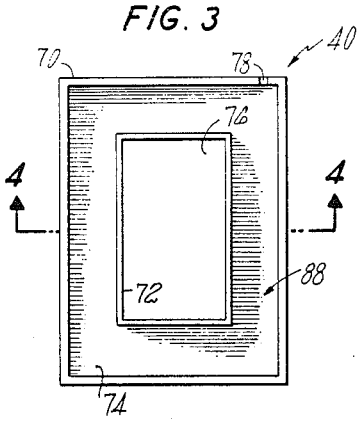
FIG. 3 is a top view of cup 40.
Figure 4:
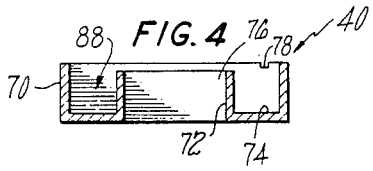
FIG. 4 is a sectional view of cup 40 taken at line IV—IV.

Referring now to FIGS. 3 and 4, there may be seen both a top and cross-sectional view of cup 40. It may be seen that that cup includes outer wall 70, inner wall 72, and bottom 74 connecting the two walls, and all three collectively defining winding receiving portion 88. The cup is formed with a U-shaped cross section as may be more specifically seen in FIG. 4. In the center of the cup is opening 76 through which the armature may be slidably displaced. Slot 78 as indicated in FIG. 4 creates a small gap through which the wires may exit the cup.

When the linear motor is assembled, the desired number of cups to achieve the appropriate stroke length and force for a linear motor are selected. These cups are then stacked in the desired arrangement and the appropriate wires extending from each cup are connected to each other. In this manner each winding may be appropriately energized. The end bells are mounted to the stack of cups, and the entire assembly may be secured by bolts extending therethrough or by welding the cups to each other and the end bells or in any other known manner.

Figure 5:
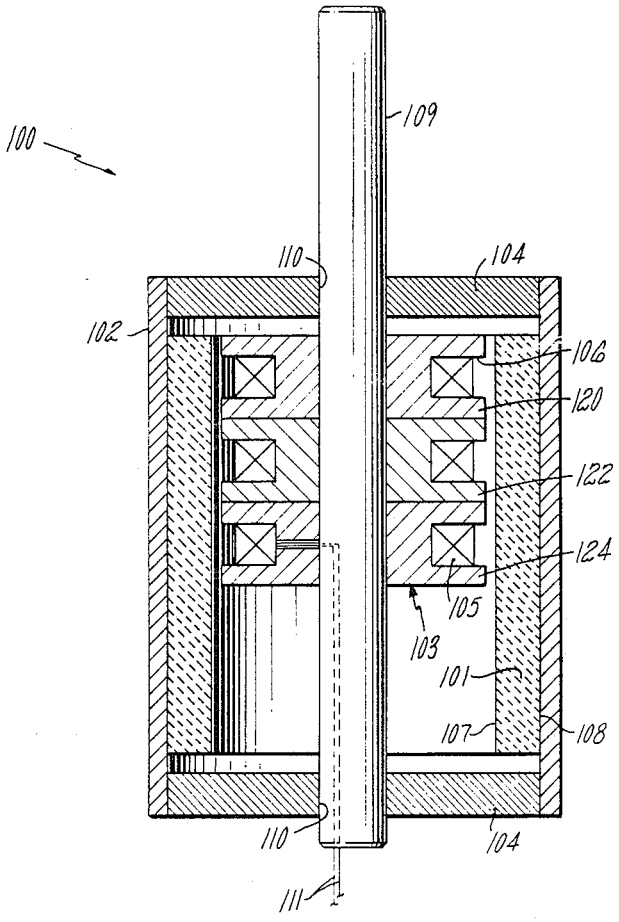
FIG. 5 is a sectional view of another embodiment of a non-commutated linear motor.

FIG. 5 discloses another embodiment wherein linear motor 100 includes permanent magnet 101 mounted about the interior surface of cylindrical housing 102. The linear motor further includes end bells 104 mounted at each end of the housing, all of which act to define the central cavity through which armature 103 may reciprocate. Armature 103 defines a cylindrical body having circumferentially extending grooves 106. In grooves 106 are individually placed windings 105. The axial length of armature 103 and the number of grooves and windings provided are selected to obtain the desired force and stroke length for the armature. Conductors, 111 are shown extending along shaft 109 to the windings, said windings being connected to provide an appropriate source of power for each winding. Inner face 107 of the magnet is of one polarity and outer face 108 has an opposite polarity. Depending upon the direction of the current flow through the windings, either the magnetic field will act to force the armature in one direction or the other. Each end bell 104 includes an opening 110 through which shaft 109 is slidably mounted. An appropriate bearing (not shown) may additionally be included.

Armature 103 is shown divided into segments 120, 122 and 124. Each segment includes at least one groove 106. The number of segments selected to constitute the armature may be varied based on the desired stroke length and force in the same manner the number of cups for the motor shown in FIG. 1 is determined. Armature 103 may also be an integral member wherein the segments are just portions of said integral member.

Figure 6:
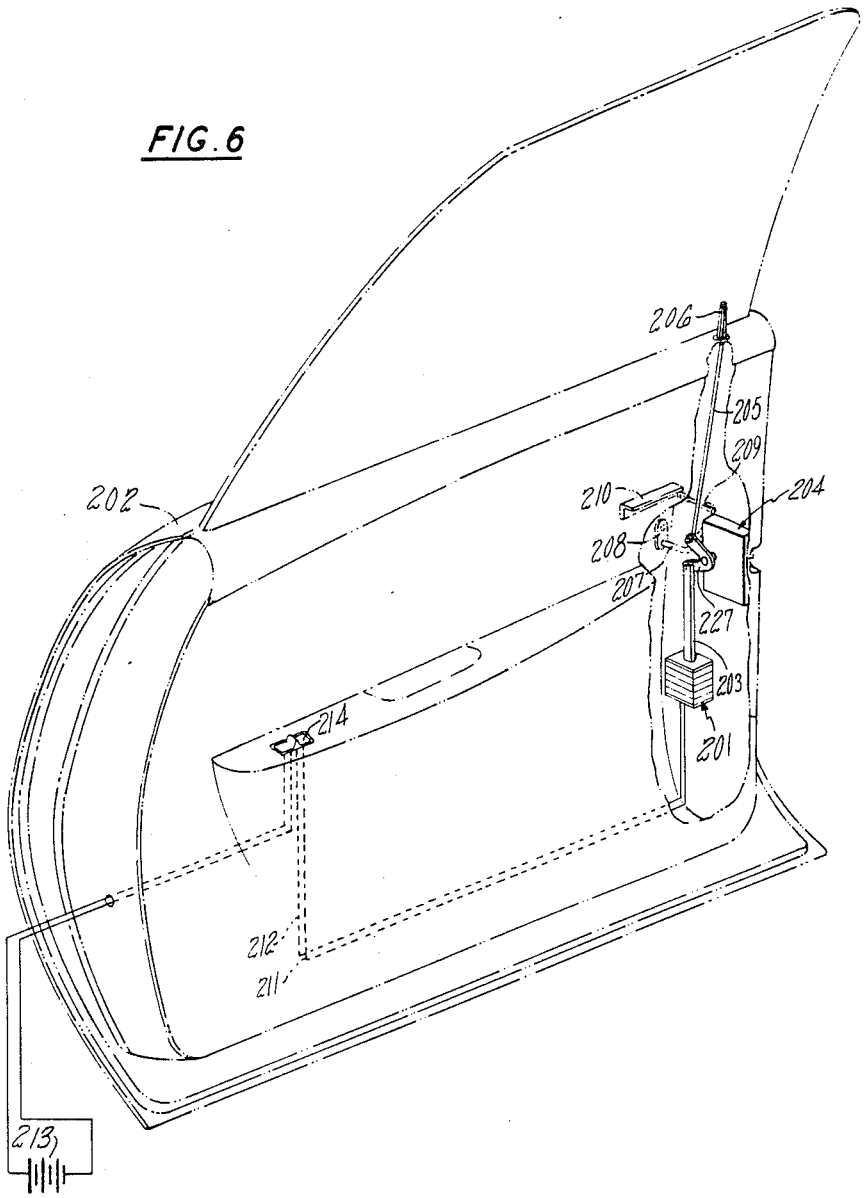
FIG. 6 is a partially cutaway perspective view of an automotive door showing the door lock mechanism and linear motor.

FIG. 6 is a perspective view of an automobile door showing the typical location of a door latch and lock mechanism and a linear motor for actuating same. Linear motor 201 is shown mounted between the inner and outer panels of an automobile door 202. Connecting link 203 extends from the linear motor to a door latching and locking mechanism 204. The connecting link, which may be the shaft of the linear motor, is driven back and forth by the linear motor. Connecting rod 205 is an extension of latch and lock mechanism to manual control button 206 located near the bottom edge of the window. This button is used to manually lock and unlock the door latching mechanism. Another connecting rod 207 extends from the latch and lock mechanism to a key operated actuator 208 that is accessible from outside the door. Connecting rod 209 extends from the latch and lock mechanism to the door handle 210 which is used to unlatch the door.

Conductors 211 and 212 supply current to the linear motor from a battery 213 through double pole, double throw control switch 214 located on the inner panel of the door. The arrangement of the various elements just described can be considered typical for an automobile door with the exception of the substitution of a linear motor for a rotary motor and gear train.

Figure 7:
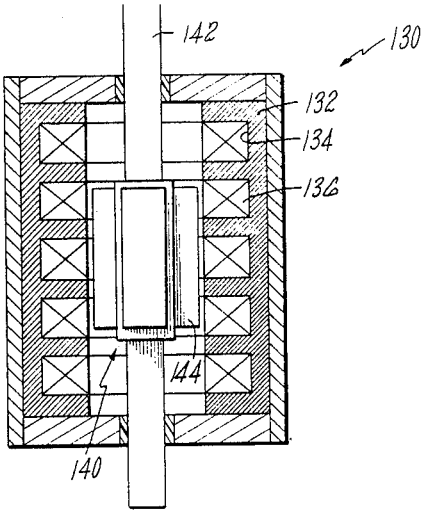
FIG. 7 is a sectional view of another embodiment of a non-commutated linear motor.

FIG. 7 shows linear motor 130 having inner housing 132 which defines grooves or winding receiving segments 134. A winding 136 is located in each groove. The inner housing may be formed from a plurality of distinct portions affixed together or may be an integral member. Armature 140 including magnets 144 and armature shaft 142 is shown mounted for reciprocal motion within the housing. The motor of FIG. 7 is similar to the motor of FIG. 1 using the construction of the winding receiving portion as shown in FIG. 5. An outer housing and end bells similar to FIG. 1 are also shown.

Figure 8:
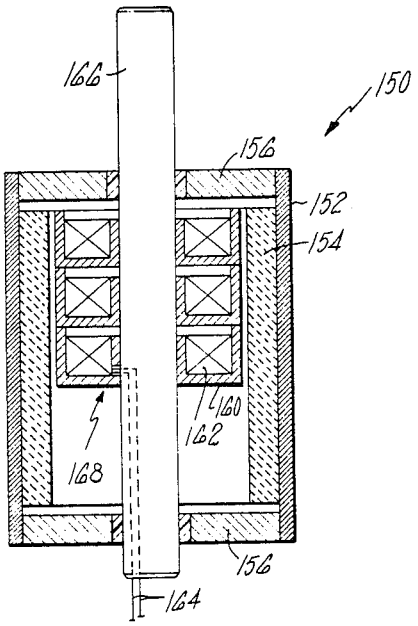
FIG. 8 is a sectional view of another embodiment of a non-commutated linear motor.

FIG. 8 shows a linear motor similar to the motor of FIG. 5 but using the cup structure of FIG. 1. In FIG. 8 motor 150 includes housing 152 and magnets 154 mounted about the interior of the housing. End bells 156 are mounted at each end of the housing and secure the armature for reciprocal motion. Armature 168 includes armature shaft 166 extending through openings in the end bells and further includes modules 160. Each module 160 may be similar to the module shown in FIGS. 3 and 4 and may be press fit or otherwise attached to shaft 166. Windings 162 are located in each module and are electrically connected to leads 164 running along the shaft.

The invention has been described with reference to a particular embodiment, but it will be understood by those skilled in the art that variations and modifications can be effected within the spirit and scope of the invention.

I claim:

1. A DC linear motor which comprises:

a plurality of windings electrically connected in series;

a stack formed from a plurality of winding portions positioned to secure the windings of the motor, each portion defining a winding receiving segment in which a winding may be positioned, and a central opening;

an armature including at least one permanent magnet mounted within the central opening defined by the portions, the movement of said armature being controlled by the polarity of the current flowing through the windings; and end means mounted to each end of the stack of winding portions, said end means including means for securing the armature for sliding motion relative to the stack of winding portions.

2. The apparatus as set forth in claim 1 wherein each winding portion is a segment of an integrally formed stack.

3. The apparatus as set forth in claim 1 wherein each winding portion is a distinct winding module and said stack comprises a plurality of modules assembled together.

4. The apparatus as set forth in claim 3 wherein each winding module comprises an inner wall and an after wall defining the winding receiving segment therebetween in which a winding may be positioned.

5. The apparatus as set forth in claim 4 wherein each winding module further comprises a bottom portion connected between the inner wall and the outer wall to collectively define the winding receiving segment.

6. The apparatus as set forth in claim 2 or 3 wherein the portion is rectangular in configuration and wherein the winding within the winding receiving portion is also rectangular in configuration.

7. The apparatus as set forth in claim 6 wherein the central opening defined by the portion is rectangular in configuration.

8. The apparatus as set forth in claim 5 wherein the outer wall of the module defines a slot through which a portion of the winding may extend.

9. An automobile power door lock mechanism which comprises:

a latch and lock mechanism for latchably securing the door in a closed position and for locking the latch when in the closed position, said latch and lock mechanism receiving a series of mechanical inputs;

a power drive mechanism connected to provide an input to the latch and lock mechanism to either lock or unlock said mechanism, said power drive mechanism including a linear motor having an armature including a shaft which is connected to the latch and lock mechanism, said shaft being driven by the linear motor between the locked and unlocked positions of the mechanism; and said linear motor further comprising a plurality of windings electrically connected in series, a stack formed from a plurality of winding portions positioned to secure the windings of the linear motor, each portion defining a winding receiving segment in which one of said windings may be positioned, a central opening through which the armature may reciprocate, means mounted to each end of the stack of winding portions for securing the armature for sliding motion relative to the stack, said sliding motion relative to said stack being caused by energization of the linear motor windings effecting displacement of the armature in a direction controlled by the polarity of the current flowing through the windings, said armature being connected to the latch and lock mechanism to either lock or unlock said mechanism.

10. The apparatus as set forth in claim 9 wherein one of the inputs to the latch and lock mechanism comprises a manually operable key input to unlock the door and wherein said power drive mechanism is so arranged that displacement of the key effects sliding displacement of the armature when the linear motor is not energized.

11. The apparatus as set forth in claim 9 wherein the winding portion comprises a winding module having an inner wall and an outer wall connected by a bottom portion to define the winding receiving segment therebetween, and wherein said outer wall defines a slot through which a portion of the winding may extend.

12. The apparatus as set forth in claim 11 wherein the linear motor is rectangular in cross section and sized to readily fit within an automobile door, said winding modules likewise having a rectangular configuration.

13. The apparatus as set forth in claim 12 wherein each winding module defines a rectangular opening and further comprising a rectangular armature having permanent magnets as a part thereof, said armature being rectangular in cross section and sized to fit within the rectangular opening of the winding module.

14. A non-commutated linear DC motor which comprises:

a circumferentially extending housing;

a permanent magnet mounted to the interior of the housing and having an outer face adjacent the housing of one polarity and an inner face opposite therefrom of the opposite polarity;

an armature defining a series of portions and sized to fit interior of the housing and the magnet, each portion defining a winding receiving opening, and said armature including an axially extending armature shaft;

a plurality of windings electrically connected in series, each winding being position within a winding receiving opening;

end bells mounted at either end of the housing to encase the armature there within, each end bell defining an opening through which an armature shaft may extend and be slidably supported; and means co-acting with the armature shaft to electrically connect the windings with an appropriate power source, said power source being applied to the windings to create a field which interacts with the field generated by the permanent magnet to cause the armature to be displaced in one of two axial directions depending on the polarity of the power supplied to the windings.

15. The apparatus as set forth in claim 14 wherein the armature is formed from a series of portions of appropriate number all secured to the armature shaft.

16. The apparatus as set forth in claim 14 wherein the armature is formed from a single core which is subdivided into a series of segments.

17. The apparatus as set forth in claim 14 wherein the armature is formed from a series of separate winding modules appropriately positioned, each module having an inner wall and an outer wall defining a winding receiving segment therebetween in which a winding may be positioned.

18. The apparatus as set forth in claim 17 wherein each winding module further comprises a bottom portion connected between the inner wall and the outer wall to collectively define the winding receiving segment.

19. The apparatus as set forth in claim 14 wherein the openings defined by the end bells are sufficiently sized to receive a bearing and wherein a bearing is mounted within said opening such that the armature shaft is secured within the bearing for sliding motion.

20. The apparatus as set forth in claim 14 wherein each receiving opening comprises a recessed circumferentially extending groove.

21. An automobile power door lock mechanism which comprises:

a latch and lock mechanism for latchably securing the door in a closed position and for locking the latch when in the closed position, said latch and lock mechanism receiving a series of mechanical inputs, and a power drive mechanism connected to provide an input on the latch and lock mechanism to either lock or unlock said mechanism, said power drive mechanism including a linear motor having an armature including a shaft which is connected to the latch and lock mechanism, said shaft being driven by the linear motor between the locked and unlocked positions of the mechanism; and said linear motor further comprising a circumferentially extending housing, a permanent magnet mounted to the interior of the housing and an armature defining a series of portions and sized to fit interior of the housing and the magnet, each portion defining a winding receiving opening and said armature including an armature shaft, a plurality of windings electrically connected in series, one located in each winding receiving opening, means mounted to each end of the housing for securing the armature for sliding motion relative to the housing, said sliding motion relative to said housing being caused by energization of the linear motor windings effecting displacement of the armature which is connected to the latch and lock mechanism to either lock or unlock said mechanism depending on the polarity of the current supplied to the windings.

22. The apparatus as set forth in claim 21 wherein one of the inputs to the latch and lock mechanism comprises a manually operable key input to unlock the door and wherein said power drive mechanism is so arranged that displacement of the key effects sliding displacement of the armature when the linear motor is not energized.

23. The apparatus as set forth in claim 21 wherein the winding portion comprises a winding module having an inner wall and an outer wall connected by a bottom portion to define a winding receiving segment therebetween in which a winding may be positioned, and wherein said outer wall defines a slot through which a portion of the winding may extend.

24. The apparatus as set forth in claim 23 wherein the linear motor is rectangular in cross section and sized to readily fit within an automobile door, said winding modules likewise having a rectangular configuration.

* * * * *